United States Patent [19]

Fröhlich

[11] Patent Number: 4,836,251

[45] Date of Patent: Jun. 6, 1989

[54] METHOD OF PRODUCING A SLIDE-FASTENER STRINGER ON A NEEDLE LOOM

[75] Inventor: Alfons Fröhlich, Essen, Fed. Rep. of Germany

[73] Assignee: Opti- Patent, Forschungs-Und Fabrikations-AG, Riedern-Allmeind, Switzerland

[21] Appl. No.: 199,013

[22] Filed: May 26, 1988

[30] Foreign Application Priority Data

May 27, 1987 [DE] Fed. Rep. of Germany ..... 3717868

[51] Int. Cl.[4] ..... D03D 1/00; D03D 41/00

[52] U.S. Cl. ..... 139/116; 139/452; 139/118

[58] Field of Search ..... 139/11, 35, 116, 117, 139/118, 429, 452

[56] References Cited

U.S. PATENT DOCUMENTS

| | | | |
|---|---|---|---|
| 4,127,147 | 11/1978 | Frohlich | 139/11 |
| 4,149,569 | 4/1979 | Frohlich | 139/116 |
| 4,181,159 | 1/1980 | Frohlich et al. | 139/116 |
| 4,682,635 | 7/1987 | Ofusa et al. | 139/116 |

*Primary Examiner*—Henry S. Jaudon
*Attorney, Agent, or Firm*—Herbert Dubno

[57] ABSTRACT

A method of producing a continuous slide fastener strip by weaving on an automatic needle loom, warp yarns for support tape and warp yarns for tying-in being guided to form sheds, weaving needles being used to pick weft yarns for the support tape and a plastics monofilament yarn. A weaving needle which reciprocates continuously between an outside position and an inside position is operative to loop the plastics monofilament yarn around a former for forming coupling members, a row thereof being formed continuously from the latter yarn, the coupling members of such row each comprising a coupling head and connected arms which form a coupling loop and being joined together by connecting parts. A kinking former is used which is in cross-section substantially rectangular, has a thickness of from 10 to 20% less then the diameter of the plastics monofilament yarn, has a rounded part for kinking extending lengthwise on the coupling-head side and is of a width greater than its thickness by a factor of approximately from 1.75 to 3, the tension of the plastics monofilament yarn infed to the weaving station is adjusted in dependence upon the diameter of such yarn. The outside position of the weaving needle is such as to produce an increase in the tension of the plastics monofilament yarn of approximately from 1.5 to 3 times, the latter yarn bearing on the former against this tension.

8 Claims, 4 Drawing Sheets

METHOD OF PRODUCING A SLIDE-FASTENER STRINGER ON A NEEDLE LOOM

FIELD OF THE INVENTION

My present invention relates to a method of producing a continuous slide fastener strip by weaving on an automatic needle loom and, more particularly, to a method of operating a needle loom to produce a continuous stringer.

BACKGROUND OF THE INVENTION

In a needle loom for weaving a slide-fastener stringer, warp yarns for the support tape and warp yarns for tying-in of the coupling element are guided to form sheds, weaving needles being used to pick weft yarns for the support tape and synthetic resin monofilament yarn forming the coupling element through the sheds.

A weaving needle reciprocates continuously between an outside position and an inside position and is operative to loop the synthetic resin monofilament yarn around a former for forming the coupling members. A row of these coupling members is formed continuously from the latter yarn, the coupling members of such row each comprising a coupling head and connected arms or shanks which form a coupling loop and being joined together by connecting parts. The said row of coupling members is tied into the evolving support tape by the tying-in warp yarns and support tape weft yarns.

The tension of the infed synthetic resin monofilament yarn is adjusted by driven feed rolls and is so influenced by the reciprocation of the weaving needle that a tension peak is produced in the outside position of the weaving needle, in which position the synthetic resin monofilament yarn is drawn onto the former. The term "slide fastener strip" denotes the unit comprising a support tape and a row of coupling members. More particularly, it may be used here as synonomous with the term "stringer" referring to two slide fastener strips associated with one another for a slide fastening action by the movement of a slider and which can be produced simultaneously with coupling member rows which are coupled together during weaving.

In this case, the former for the coupling members is an elongated needle-shaped component which is mounted self-supportingly (German patent document No. 2 540 272).

Another possibility, disclosed by Europatent document No. 0 124 129, is to use a former which is relatively short and includes a hook disposed on a swing arm. As a rule, only a single slide fastener strip is produced in this way. A second such strip is operatively associated with the first strip elsewhere and at a different time. The coupling members which have been formed on the former are continuously drawn or pushed off the former as weaving continues.

The steps known from these patent documents produce closure members and rows thereof whose dimensions, including pitch, are defined with sufficient accuracy. However, the tolerances of the coupling heads and coupling loops are excessive. Satisfactorily shaped coupling heads are not readily obtainable. The excessive tolerances described may impair the transverse tensile strength and the ability of a slide fastener to withstand opening when subjected to bending and kinking. So that closer tolerances can be observed, particularly with respect to the coupling heads, it is conventional to pre-stamp coupling heads on the infed plastics monofilament yarn, with detriment to the actual weaving operation and to the rate of weaving.

OBJECTS OF THE INVENTION

It is an object of the invention to provide an improved method of making a slide fastener strip which avoids drawbacks of earlier methods and produces very accurate closure members and coupling heads without the pre-stamping of coupling heads on the plastics monofilament yarn, leading to slide fasteners of high quality, especially as to transverse tensile strength, an ability to resist opening when subjected to bending and kinking and to the production of flexible slide fasteners at a high weaving rate.

Another object is to provide an improved method of operating a needle loom to provide high quality slide-fastener stringers.

SUMMARY OF THE INVENTION

These objects are attained in accordance with the invention using a kinking former which is in cross-section substantially rectangular, has a thickness from 20 to 20% less than the diameter of the synthetic resin monofilament yarn, has a rounded part for kinking extending lengthwise along the coupling head side and is of a width greater than its thickness by a factor of approximately from 1.75 to 3, preferably approximately 2.

The tension of the synthetic resin monofilament yarn infed to the weaving station is adjusted to be about 1500 to about 3000 g/mm$^2$ (grams of tension per mm$^2$) of the monofilament cross-sectional area. This can mean a tension of approximately from 300 to 500 grams for an approximately 0.5 mm diameter yarn, a tension of approximately 500 to 800 grams for an approximately 0.6 diameter yarn, and a tension of approximately from 800 to 1200 grams for an approximately 0.75 mm diameter yarn.

The outside position of the weaving needle is such so as to produce an increase in the tension of plastics monofilament yarn of approximately from 1.5 to 3 times, the latter yarn bearing on the former against this tension.

Kinking to form coupling heads on coupling member rows made of plastics monofilament yarn is known; however, the resulting coupling heads to not have a well-defined shape.

The invention, however, obviates this drawback, the discovery to the effect that improved kinking in the weaving method of interest here is possible first, by the use of a special kinking former and secondly, by means of special kinking tensions.

The kinking former has a longitudinal kinking rounding which contributes to kinking, besides being of a special predetermined width. This width imparts to the former the geometrical moment of inertia necessary to withstand the kinking tension without the former being damaged. This width of the former also defines the coupling loop.

Coupling heads are formed which are associated with the coupling loop and which have adequate positive securing in the coupling loops, so that the required transverse tensile strength and resistance to opening values are achieved. However, the loop is large enough for the slide fastener devised from the slide fastener strip thus produced to have completely adequate and even outstanding flexibility.

The kinking tension leads to high rates of deformation, with advantages for shaping. The coupling heads produced according to the invention by tensile kinking are stabilized during thermofixing without unwanted alterations of shape.

The inward movement of the weaving needle is preferably such that, with the needle in its inside position, the tension of the plastics monofilament yarn is increased by from 1.2 to 2.5 times, such yarn bearing on warp and/or weft yarns which extend around the previously formed connecting part. Of course, the weft yarns should be correspondingly strong and the warp yarns correspondingly numerous.

Preferably, a kinking former whose edge rounding has a radius corresponding to substantially half the thickness of the kinking former is used.

A very wide variety of plastics which are conventional in the production of slide fasteners having rows of coupling elements made of synthetic resin monofilament yarns can be used. These include polyamides (e.g. nylon) and polyester plastics. The cross-section of the latter yarns can be circular. However, particularly well-shaped coupling heads result when a synthetic resin monofilament yarn is used which is in cross-section substantially elliptical, the ratio between the minor axis and the major axis of the ellipse being of approximately from 1:1.2 to 1:1.6.

Weaving so proceeds that in the coupling heads the major axis of the elliptical cross-section extends in the slide fastener strip parallel to the longitudinal axis. Conveniently, if an elliptical cross-section plastics monofilament yarn is used, the synthetic resin monofilament yarn has the substantially elliptical cross-section imparted to it by cold rolling as it is being fed to the weaving needle.

The internal stresses left after cold rolling are advantageous for the kinking which defines the coupling heads. Of course, when elliptical cross-section plastics monofilament yarns are used, the algebraic mean of the dimension for the minor axis and the dimension for the major axis is used instead of the diameter parameters of importance for the teaching of the invention.

BRIEF DESCRIPTION OF THE INVENTION

The above objects, features and advantages of my invention will become more readily apparent from the following description, reference being made to the accompanying drawing in which.

SPECIFIC DESCRIPTION

Figure 1:
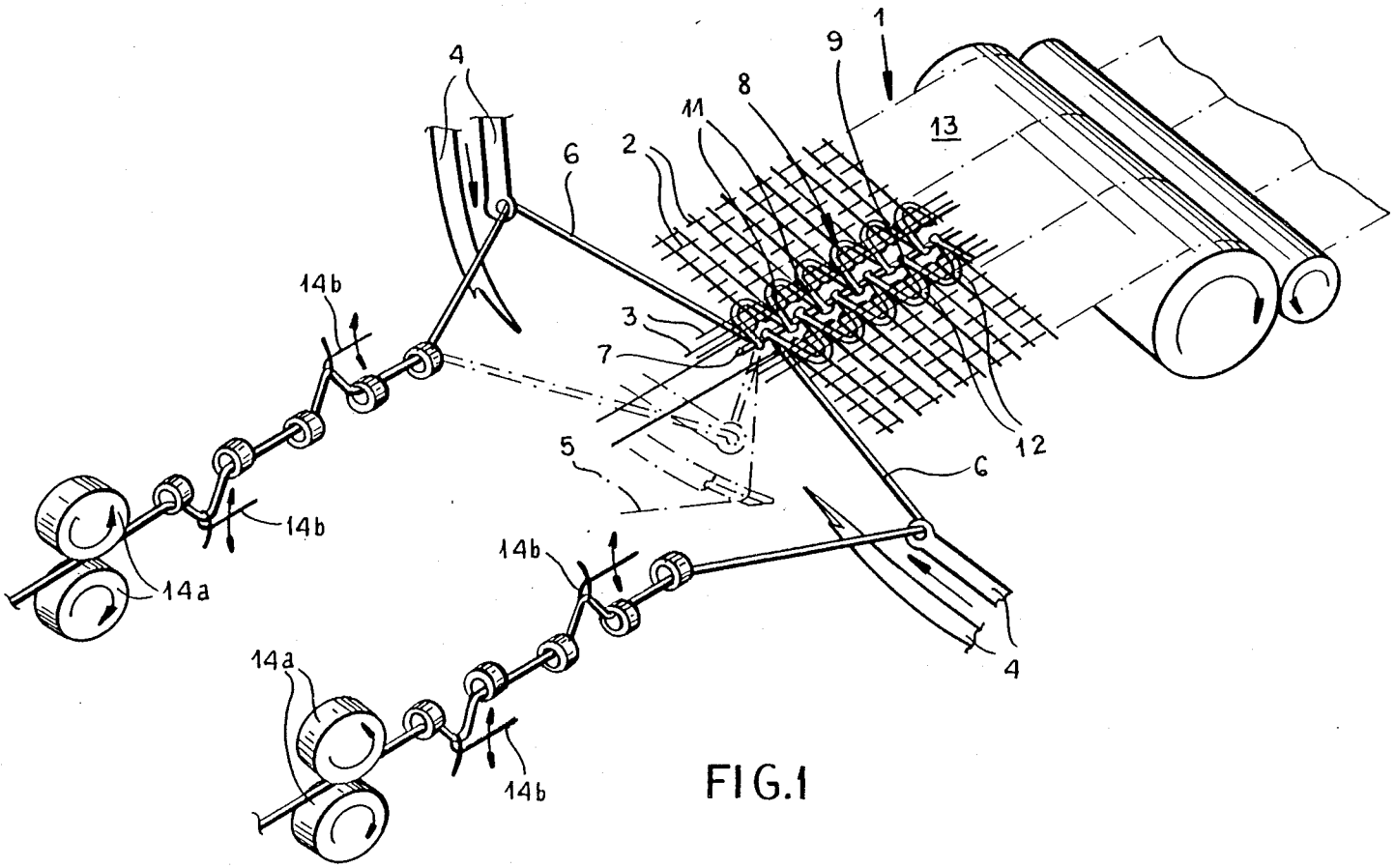
FIG. 1 is a perspective view of part of the weaving station of an automatic needle loom carrying out the method according to the invention.
Figure 2:
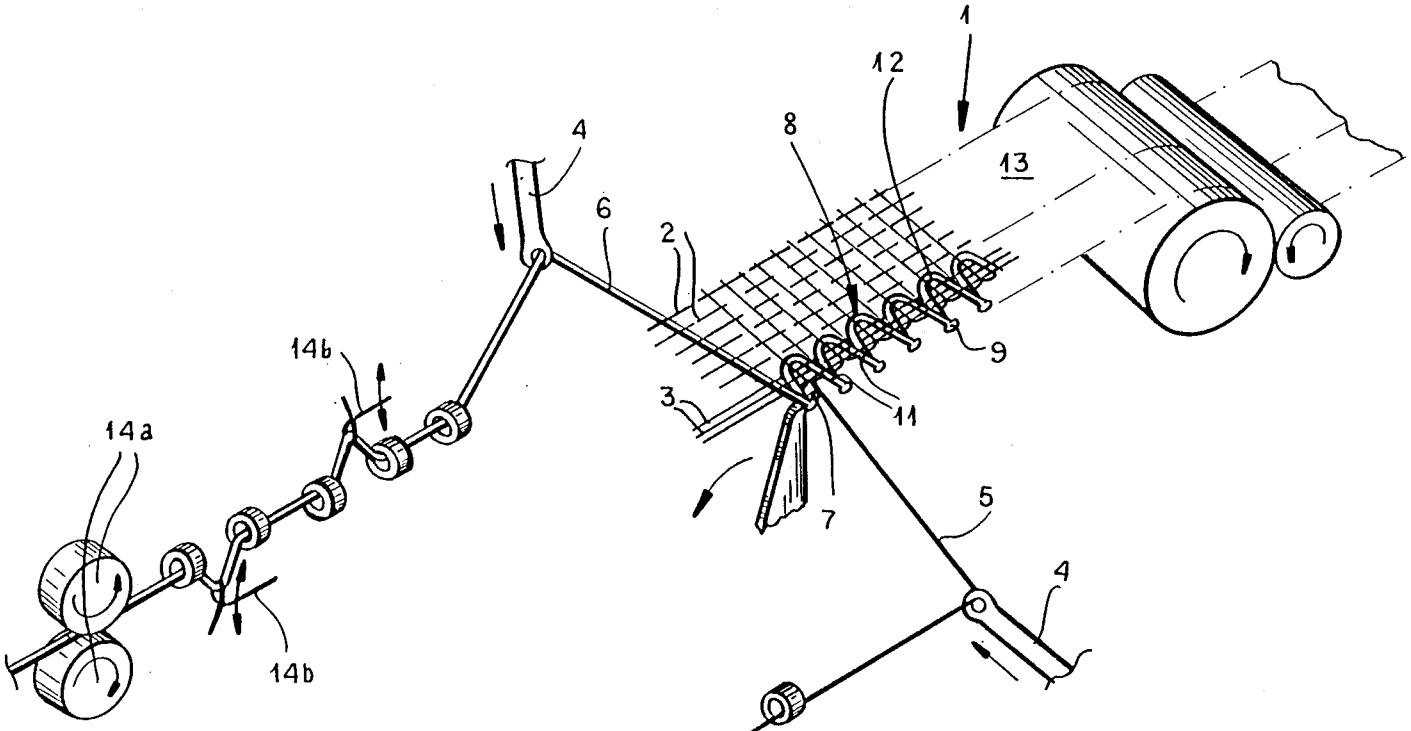
FIG. 2 is a perspective view similar to FIG. 1 of a different automatic needle loom.

From FIGS. 1 and 2, there can be seen components of an automatic loom for producing a continuous slide fastener strip 1 by weaving. Warp yarns 2 for a support tape and tying-in warp yarns 3 are guided to form sheds by a needle or shedding arrangement (not shown).

Weaving needles 4 are operative to pick yarns 5 for the support tape and, in the embodiment of FIG. 1, two synthetic monofilament yarns 6, and in the embodiment of FIG. 2, a single synthetic resin monofilament yarn 6.

Weaving is carried out so that a weaving needle 4 reciprocating continuously between an outside position and an inside position moves the filament yarns 6 around a former 7 for forming coupling members, a row thereof being formed continuously from the yarn 6.

Coupling members 8 each comprise a coupling head 9 and connected arms 11 which form a coupling loop 10. They are joined together by connecting parts 12. In this connection, reference should also be made to FIG. 4.

Also, the row of coupling members is tied into the evolving support tape 13 by means of the tying-in warp yarns and of the support tape weft yarns 5.

The tension of the infed monofilament yarn 6 is adjusted by means of driven feed rolls 14a and is also so influenced by the reciprocation of the weaving needle 4 that a tension peak is produced in the outside position of the needle 4, in which position the plastics monofilament yarn 6 is drawn onto the former.

Figure 3:
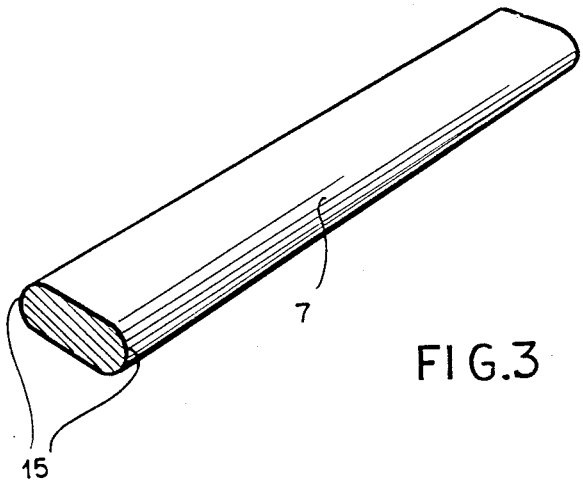
FIG. 3 is a considerably enlarged perspective view in cross-section through a former of use for the method according to the invention.

A kinking former 7 is used. Details of its construction can be gathered from a comparison between FIG. 3 and, on the other hand, FIGS. 4–6.

Figure 6:
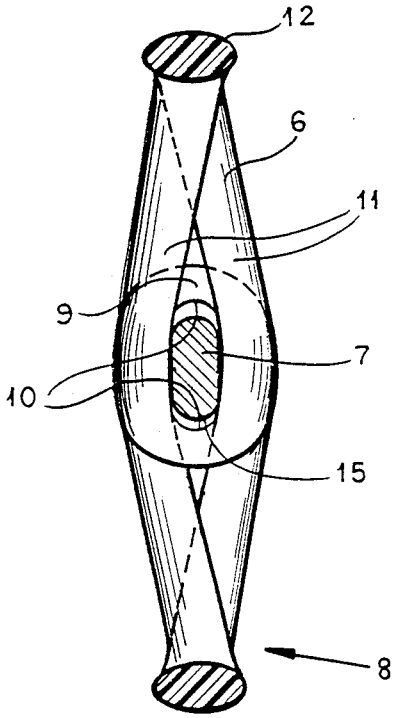
FIG. 6 is a view taken along section line VI—VI of FIG. 4.

The kinking former 7 has a substantially rectangular cross-section, a thickness of from 10 to 20% less than the diameter of the plastics monofilament yarn 6, has a rounded part for kinking extending lengthwise on the coupling head side and is of a width greater than its thickness by a factor of approximately from 1.75 to 3. This gives the former 7 a special geometrical moment of inertia and, as FIG. 6 shows, defines the size of the loops 10.

The tension of the infed yarn 6 is adjusted specially in the manner set out in claim 1, an important factor in this connection being the compensating springs **14*b*** which also effect the infed length.

The outside position of the weaving needle 4 is such that in this outward movement, the tension of the plastics monofilament yarn 6 is increased by approximately from 1.5 to 3 times, the yarn 6 then bearing on the former 7 as can be gathered from FIGS. 1 and 2. The inward movement of the needle 4 is such that, with the same in its inside position, the tension of the yarn 6 is increased by from 1.2 to 2.5 times. The yarn 6 bears on warp and/or weft yarns 2, 3 and 5, respectively, which extend around the previously formed connecting part 12.

In the embodiment, preferably the kinking former 7 has a kinking rounding 15 of a radius corresponding to approximately half the thickness of the former 7. The result of the kinking according to the invention, can be gathered from FIGS. 4 and 5.

Figure 4:
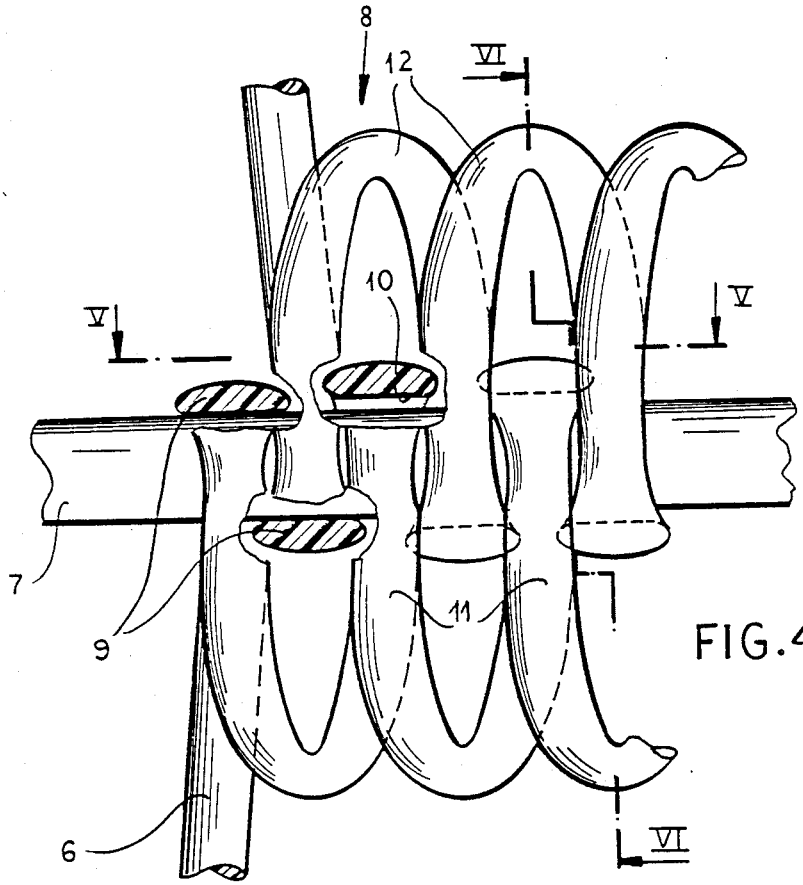
FIG. 4 is a plan view which shows the former of FIG. 3 with a plastics monofilament yarn after rounding by kinking.
Figure 5:
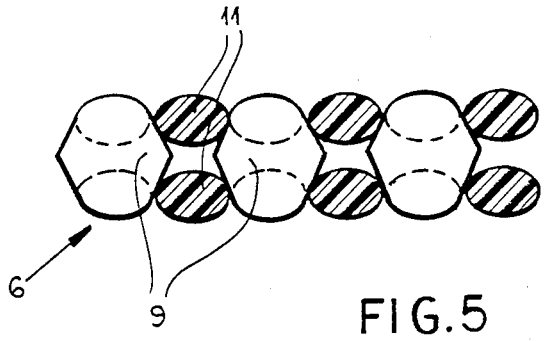
FIG. 5 is a view taken along section line V—V of FIG. 4.

Clearly defined coupling heads 9 are positioned with the deep and effective positive engagement. As FIG. 4 shows, between-axes ratios of approximately from 1:2.6 to 1:3.6 can be provided in the coupling heads 9, depending on former construction and upon tension. Also apparent from FIG. 5 is the specified between axes ratio of the yarns 6 when the same are elliptical in cross-section.

We claim:

1. In a method of producing a continuous slide-fastener strip by weaving on an automatic needle loom, wherein warp yarns for support tape and warp yarns for tying in of a coupling element form sheds into which weaving needles pick weft yarns for the support tape and a synthetic resin monofilament yarn forming the coupling element, and wherein a weaving needle reciprocates continuously at a weaving station between an outside position and an inside position being operative to loop the synthetic resin monofilament yarn around a former for forming continuously coupling members in a row, the coupling members of such row each comprising a coupling loop and being joined together by connecting parts, said row being tied into the evolving support tape by means of the tying-in warp yarns and support tape weft yarns, the tension of the infed synthetic resin monofilament yarn being adjusted by means of driven feed rolls and so influenced by the reciprocation of the weaving needle that a tension peak is produced in the outside position of the weaving needle, in which position the synthetic resin monofilament yarn is drawn onto the former, the improvement wherein:

(a) said synthetic resin monofilament yarn is kinked around said former to form said members and said former is substantially rectangular in cross-section, has a thickness of from 10 to 20% less than the diameter of the synthetic resin monofilament yarn, has a rounded part for kinking extending lengthwise on the coupling head side and is of a width greater than its thickness by a factor of approximately from 1.75 to 3;

(b) the tension of the synthetic resin monofilament yarn infed to the weaving station is adjusted to be about 1500 grams per $mm^2$ of the cross-section of the monofilament yarn to about 300 grams per $mm^2$ of the cross-section of the monofilament yarn; and (c) the outside position of the weaving is selected so as to produce an increase in the tension of the synthetic resin monofilament yarn of approximately from 1.5 to 3 times, the latter bearing on the former with the increased tension.

2. The improvement defined in claim 1 wherein the inward movement of the weaving needle is such that, with the weaving needle in its inside position, the tension of the synthetic resin monofilament yarn is increased by from 1.2 to 2.5 times, the monofilament yarn bearing on yarns which extend around the previously formed connecting part.

3. The improvement defined in claim 1 wherein the kinking former has an edge rounding of a radius corresponding to substantially half the thickness of the kinking former and the monofilament is kinked around the former and the monofilament is kinked around the edge rounding.

4. The improvement defined in claim 1 wherein the synthetic resin monofilament yarn which is used has a cross-section which is substantially elliptical, the ratio between the minor axis and the major axis of the ellipse being of approximately from 1:1.2 to 1:1.6.

5. The improvement defined in claim 4 wherein said monofilament yarn has the substantially elliptical cross-section imparted to it by cold rolling as it is being fed to the weaving needle.

6. The improvement defined in claim 1 wherein the tension of the monofilament yarn fed to the weaving station is approximately 300 to 500 grams for an approximately 0.5 mm diameter yarn.

7. The improvement defined in claim 1 wherein the tension of the monofilament yarn fed to the weaving station is approximately 500 to 800 grams for an approximately 0.6 mm diameter yarn.

8. The improvement defined in claim 1 wherein the tension of the monofilament yarn fed to the weaving station is approximately 800 to 1200 grams for an approximately 0.75 mm diameter yarn.

* * * * *